US007628559B2

(12) United States Patent
Petit

(10) Patent No.: US 7,628,559 B2
(45) Date of Patent: Dec. 8, 2009

(54) ROTATING APPLICATOR AND DISTRIBUTOR OF A PRODUCT, TYPICALLY A COSMETIC PRODUCT, COMPRISING THE SAID APPLICATOR

(75) Inventor: Robert Petit, Cluny (FR)

(73) Assignee: Techpack International, Chevilly-Larue (FR)

( * ) Notice: Subject to any disclaimer, the term of this patent is extended or adjusted under 35 U.S.C. 154(b) by 554 days.

(21) Appl. No.: 11/145,066

(22) Filed: Jun. 6, 2005

(65) Prior Publication Data

US 2006/0275072 A1 Dec. 7, 2006

(51) Int. Cl.
*B43M 11/02* (2006.01)

(52) U.S. Cl. ..... 401/219; 401/208; 401/126

(58) Field of Classification Search ..... 401/208, 401/218, 219, 220, 126; 15/230.11; 494/31–34
See application file for complete search history.

(56) References Cited

U.S. PATENT DOCUMENTS 4,648,732 A * 3/1987 Smialkowski ..... 401/196
D299,972 S * 2/1989 Moore ..... D28/7
5,051,016 A * 9/1991 Bengston ..... 401/213
5,564,851 A 10/1996 Connelly et al.
5,810,027 A 9/1998 Frantzeskakis
5,875,514 A * 3/1999 Friess ..... 15/230.11
5,934,816 A * 8/1999 Bruttomesso ..... 401/208
5,996,166 A * 12/1999 Shehow ..... 15/230.11
6,141,821 A * 11/2000 Chin ..... 15/230.11
6,155,736 A 12/2000 Evans et al.

FOREIGN PATENT DOCUMENTS

| | | |
|---|---|---|
| BE | 471 003 | 2/1947 |
| DE | 40 30 334 | 4/1992 |
| EP | 0 375 579 | 6/1990 |

* cited by examiner

*Primary Examiner*—David J Walczak
(74) *Attorney, Agent, or Firm*—Young & Thompson

(57) ABSTRACT

The applicator (1, 1') of a cosmetic product (6) includes a manual gripping element (2) and an application member (3) of the product (6), and is characterized in that:

a) the application member (3) includes at least one fixed element (30) and one rotating element 131), forming an application roller free to rotate about the fixed element (30) about a rotation axis (10), b) the fixed element (31) is typically fixed to the manual gripping element (2), c) the fixed element (30) and the rotating element (31) are fixed by reversible or irreversible cooperation.

Advantages are easier application resulting in a different appearance.

28 Claims, 6 Drawing Sheets

ROTATING APPLICATOR AND DISTRIBUTOR OF A PRODUCT, TYPICALLY A COSMETIC PRODUCT, COMPRISING THE SAID APPLICATOR

FIELD OF THE INVENTION

The invention relates to the field of product applicators and particularly cosmetic applicators, and distributors comprising such applicators.

STATE OF THE ART

Many applicators are already known for makeup and face care and skin care in general.

Thus, for example, products in the form of compact powder packaged in cases, typically use a powder puff or a brush as a powder application means.

For powder that is not agglomerated, distributors are known comprising a brush, for example like that described in French applications No. 99 15615 and No. 01 04572.

A distributor-applicator with a flexible end piece is already known in European application No. 00 00400175.2, for fluid products.

For mascaras, applicators in the form of a brush mounted on a rigid rod are known.

PROBLEMS THAT ARISE

Applicators according to the state of the art typically comprise a gripping means and another means of transferring the product to be applied onto a support.

As mentioned beforehand, application means according to the state of the art are composed typically of a brush fixed to a manual gripping means that may also act as a lid for a receptacle containing the product to be applied, as is the case for mascaras.

When the brush containing the product to be applied is used, it is placed on the support (nails, eyelashes, skin, etc.) and moved on the support so as to leave a deposit of the product. As is already known, such a deposit may comprise a frequently non-homogenous and very often striated surface caused by translation of the brush during application of the product.

Moreover, in general, there is a permanent need for new applicators to the extent that new applicators can give new visual effects on the face, and also make it easier to apply the products to be applied, even when using the same product to be applied.

DESCRIPTION OF THE INVENTION

According to the invention, the applicator of a product intended to be deposited on a support comprises a manual gripping means and a means of application of the said product and is characterised in that:

a) the said application means comprises at least one fixed element and one rotating element, with typically axial symmetry, the said fixed element 30 and the said rotating element 31 cooperating in rotation to form a "hub 4-axle 5" assembly with a rotation axis 10, such that a manual displacement of the said applicator in order to make a localised deposit of the said product on the said support causes a rotation of the said rotating element brought into contact with the said support and typically transfer of the said product present on the said rotating element onto the said support, b) the said fixed element is typically fixed to the said manual gripping means, c) the said fixed element and the said rotating element are fixed by reversible or irreversible cooperation.

As has been observed, the presence of a rotating element has changed the appearance of the deposit of cosmetic product typically formed on the face from what could be obtained with the traditional applicator such as a powder puff, since a deposit by "rolling" is not the same as a deposit obtained by "brushing". Furthermore, the presence of a rotating element has also facilitated deposit of the said product.

Furthermore, the said applicator can also modify the appearance of a previously made product deposit.

DESCRIPTION OF THE FIGURES

All figures relate to the invention.

Marks 1 and 1' were assigned to applicators and to applicator-distributors according to the invention, respectively.

FIG. 2*a* shows a top view of the said applicator 1 in which the said rotating element 31 is a cylindrical roller.

FIG. 2*b* shows a top view of a rotating element 31 with a concave surface in the form of a "bobbin".

Figure 1A:
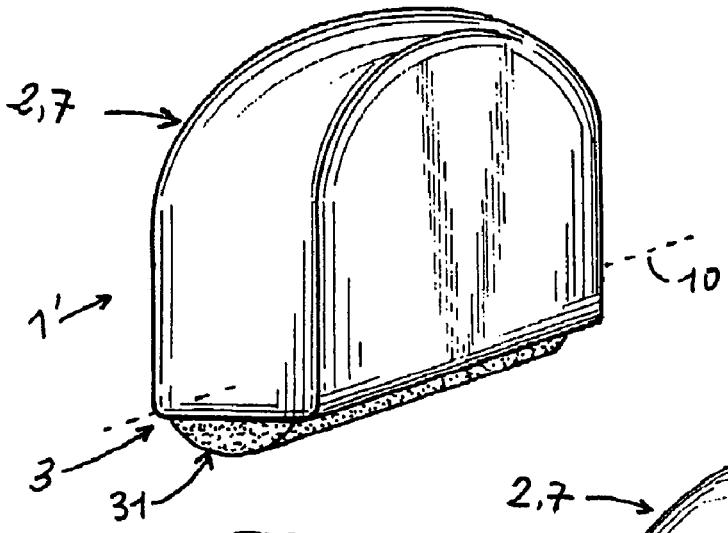
FIGS. 1*a* and 1*b* show perspective side views of an applicator-distributor 1', FIG. 1*a* being an external view and FIG. 1*b* being a view showing the arrangement of parts inside the applicator-distributor 1'.

It comprises two embodiments: either the rotating element 31 is fixed to a stick 34 for which the lower end rotates in the gripping means 2 that itself forms the said hub, or the rotating element 31 turns on the fixed element 30 forming the extension of the stick 22, this rotating element forming the hub 4; the marks of this second possibility have been entered between parentheses.

Figure 3:
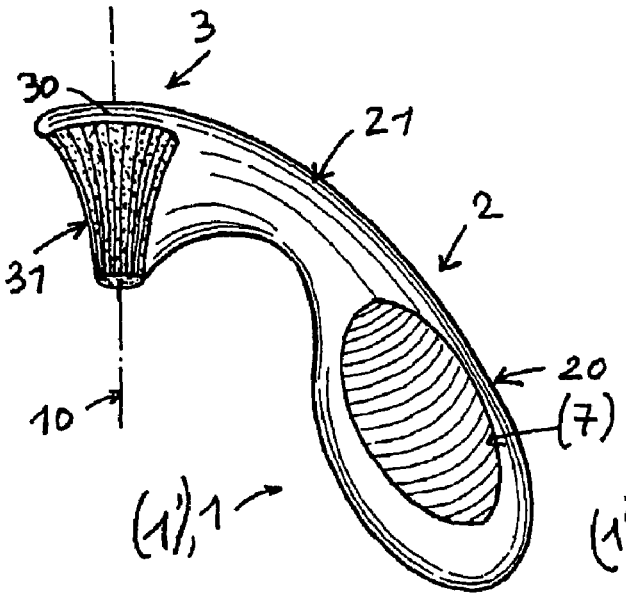
FIG. 3 shows a side view of an applicator 1 or an applicator-distributor 1' in which the said gripping means 2 is positioned at the side of the said rotation axis 10.
Figure 4:
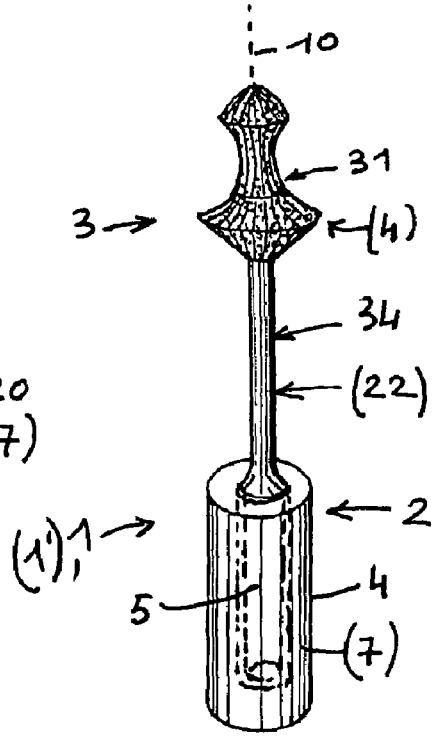
FIG. 4 shows a perspective view of an applicator 1 or an applicator-distributor 1' in which the said gripping means 2 is positioned in line with the rotation axis 10.

FIGS. 5*a* to 5*d* show views of a rotating element 31 formed from axial tabs 312, with axial recesses between them 311, the said rotating element having a tapered and concave envelope surface as shown in FIGS. 3 and 4.

Figure 5A:
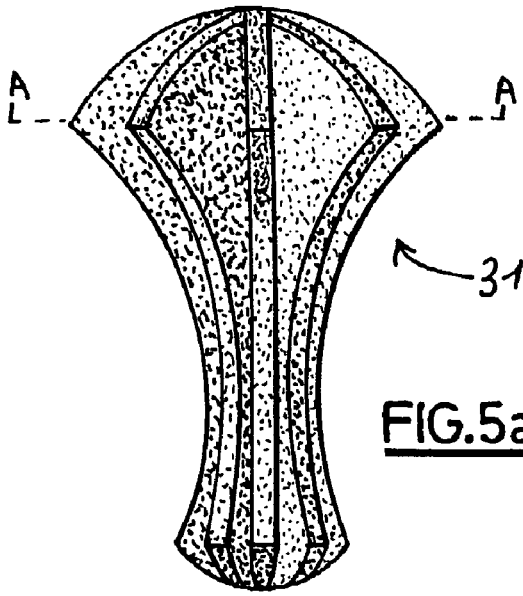

FIG. 5*a* shows a side view.

Figure 5B:
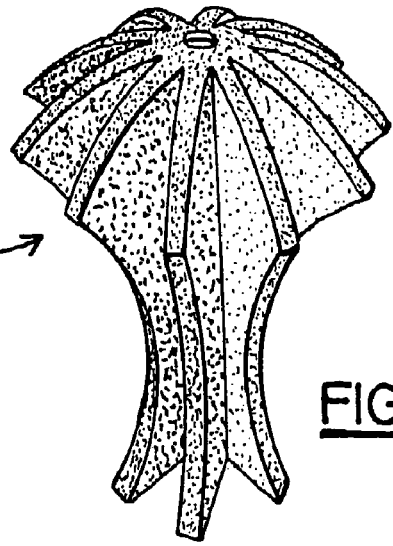

FIG. 5*b* shows a perspective side and top view.

Figure 5C:
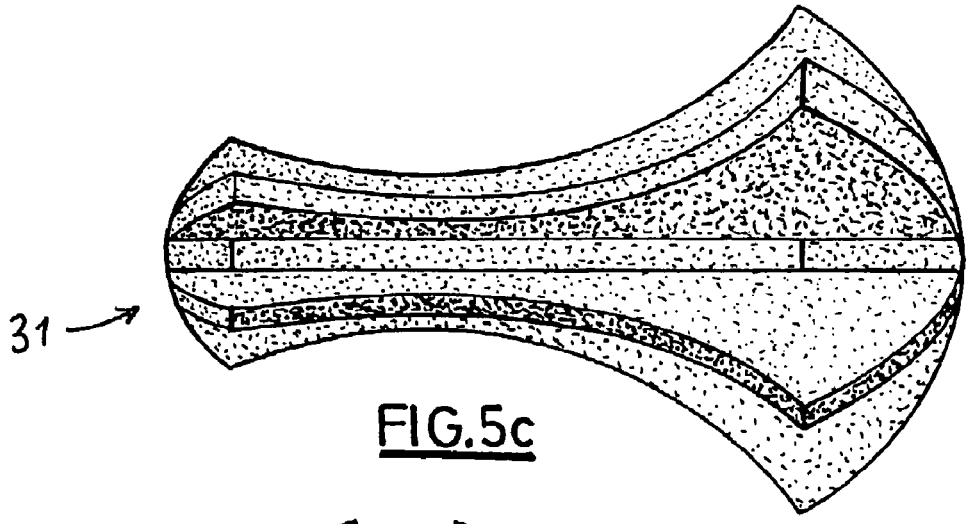

FIG. 5*c* shows an enlarged view of FIG. 5*a*, the said rotating element 31 being turned by 90°.

Figure 5D:
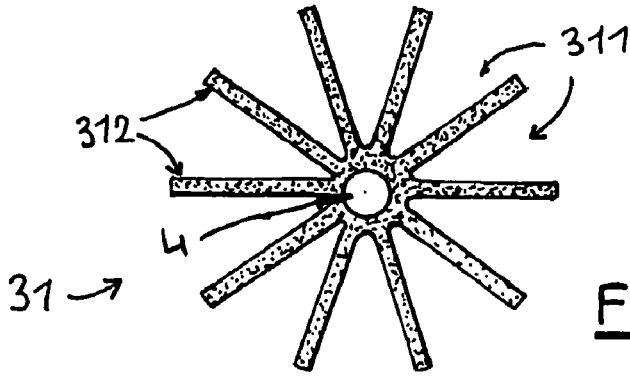

FIG. 5*d* shows a view of the said rotating element 31 of FIG. 5*a* according to section A-A.

FIG. 6*a* to 6*e* show views of different rotating elements 31.

Figure 6A:
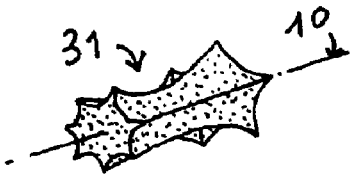
Figure 6B:
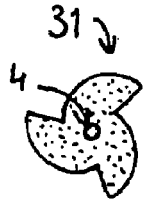
Figure 6C:
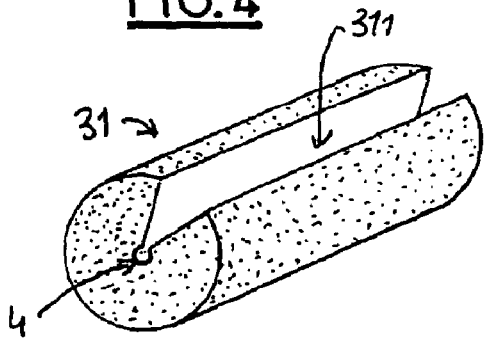
Figure 6D:
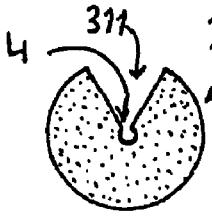
Figure 6E:
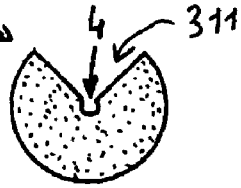

FIGS. 6*a* and 6*c* show perspective views, while FIG. 6*b*, 6*d* and 6*e* show sectional views in a plane perpendicular to the rotation axis 10.

Figure 7A:
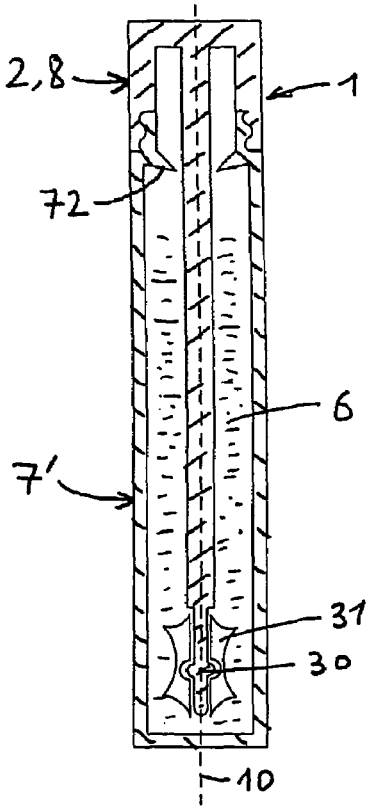

FIG. 7*a* shows an axial sectional view along the rotation axis 10 of an applicator 1 of the type shown in FIG. 4, in which the said manual gripping means 2 forms a threaded cap 8 that cooperates with a reservoir 7' containing the said product 6 and for which the upper end comprises a threaded opening provided with a wiping ring 72 on the inside.

Figure 7B:
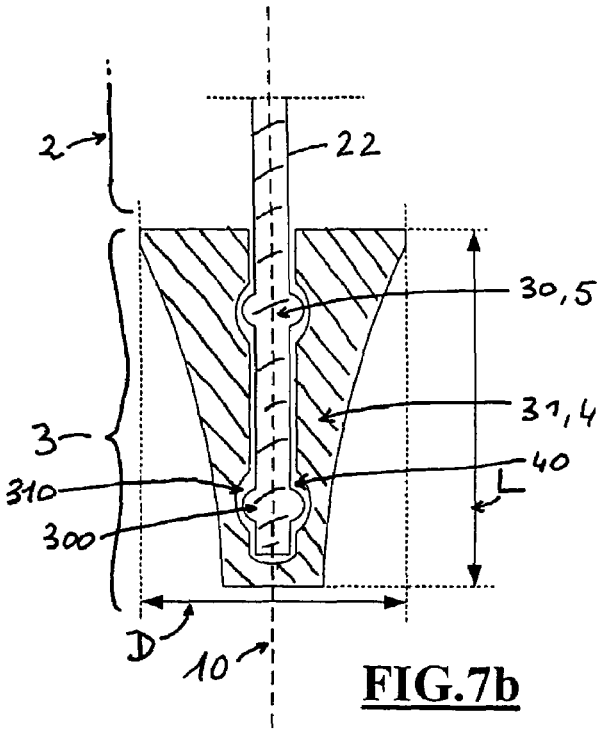

FIG. 7*b* shows an axial sectional view of an application means 3 of a type similar to that in FIGS. 7*a* and 4*a*.

Figure 7C:
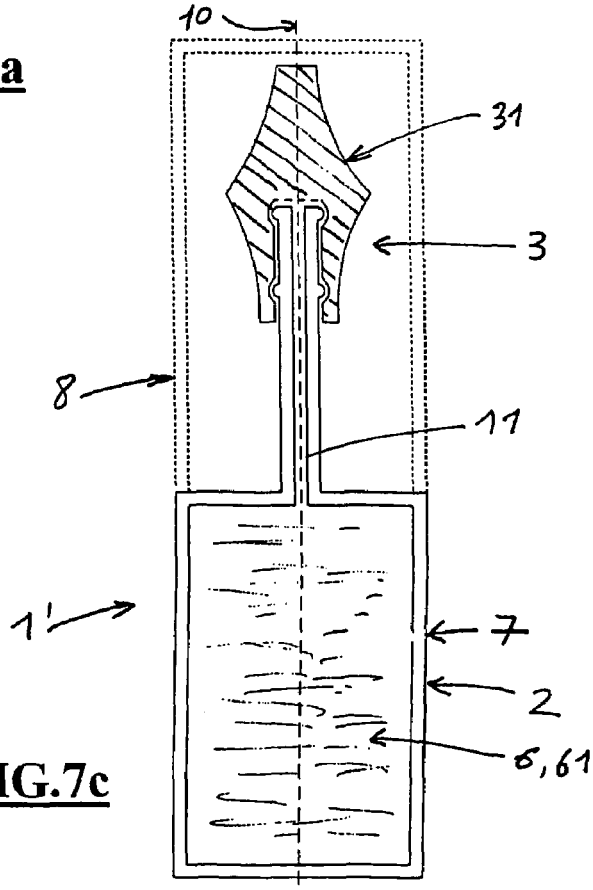

FIG. 7*c* shows an axial sectional view of an applicator-distributor 1' of the type shown in FIG. 4, closed by a cap 8 shown in dashed lines.

Figure 2A:
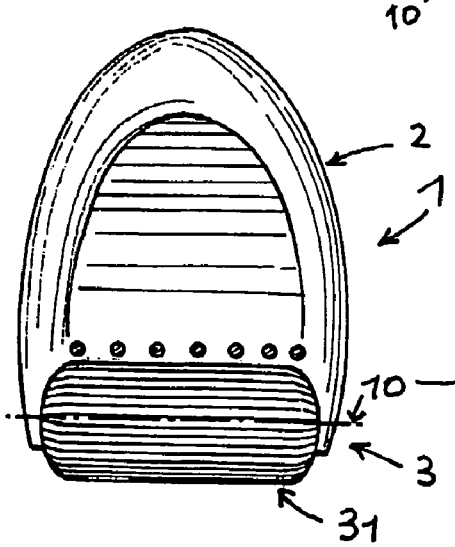
FIGS. 2*a* and 2*b* relate to an applicator 1 in which the gripping means 2 is positioned at the side of the rotation axis 10 of the rotating element 31.
Figure 8A:
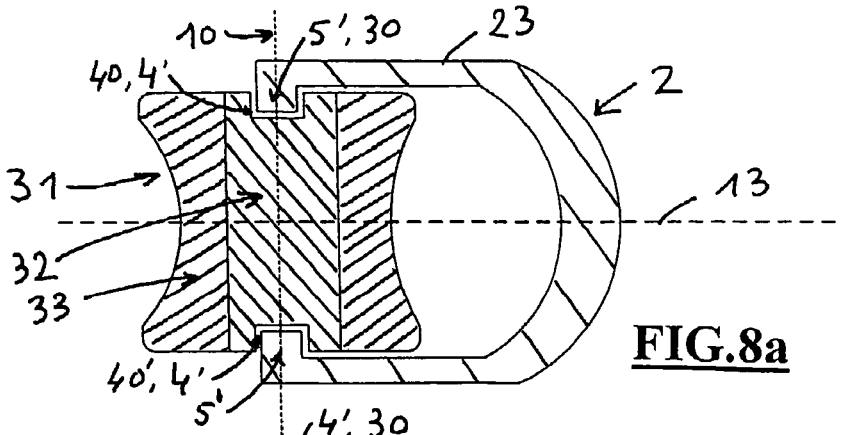
Figure 8B:
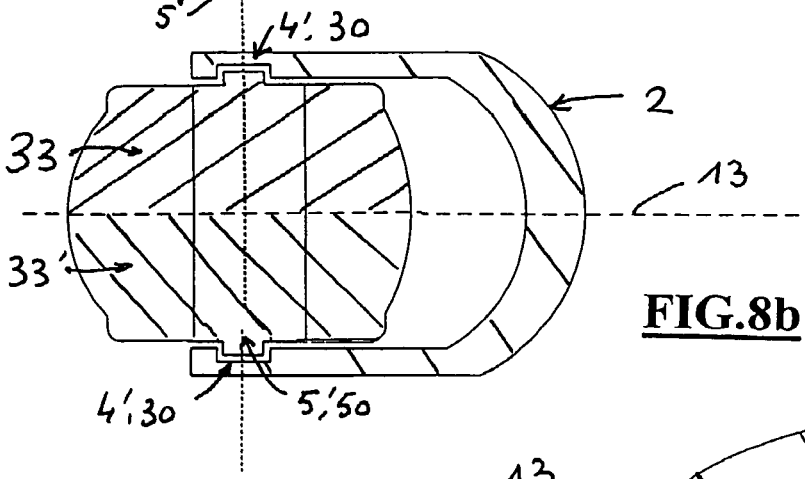

FIGS. 8*a* and 8*b* are cross-sectional views in the plane of the rotation axis 10 of applicators 1 of the type shown in FIG. 2*a*.

In FIG. 8*a*, the fixed element 30 is formed from two pins 5', while the fixed element 30 in FIG. 8*b* is formed from two blind holes 4'.

Figure 8C:
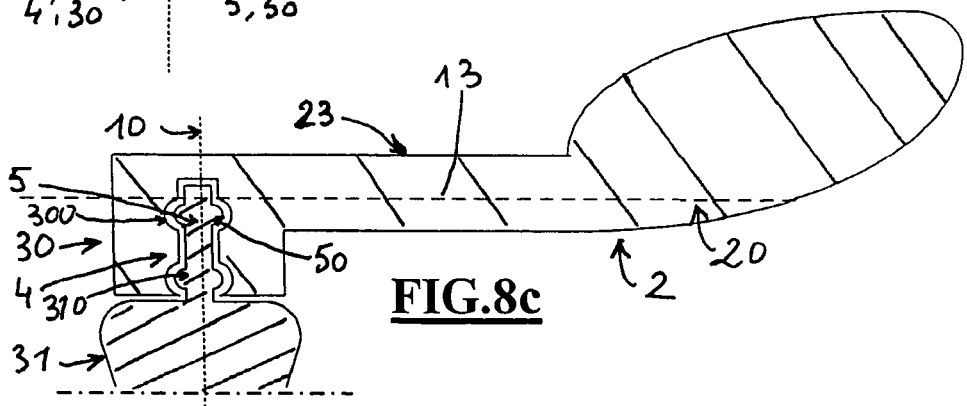
Figure 8D:
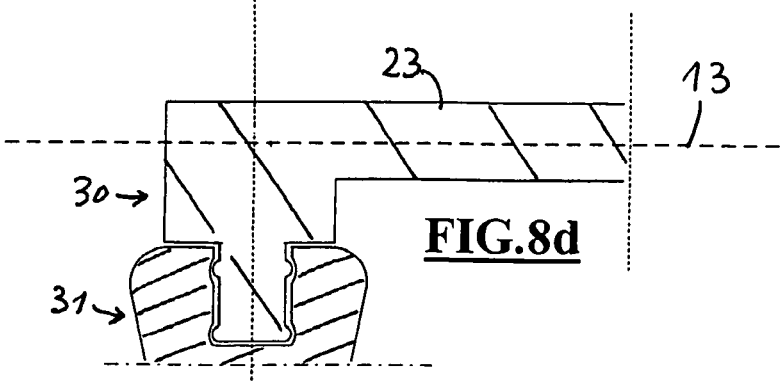

FIGS. 8*c* and 8*d* show partial sectional views along the rotation axis 10 of applicators 1 similar to that in FIG. 3. In FIG. 8*c*, the rotating element 31 supports an axle 5 while the fixed element 30 forms the corresponding hub 4, FIG. 8*d* having the reverse arrangement.

Figure 9A:
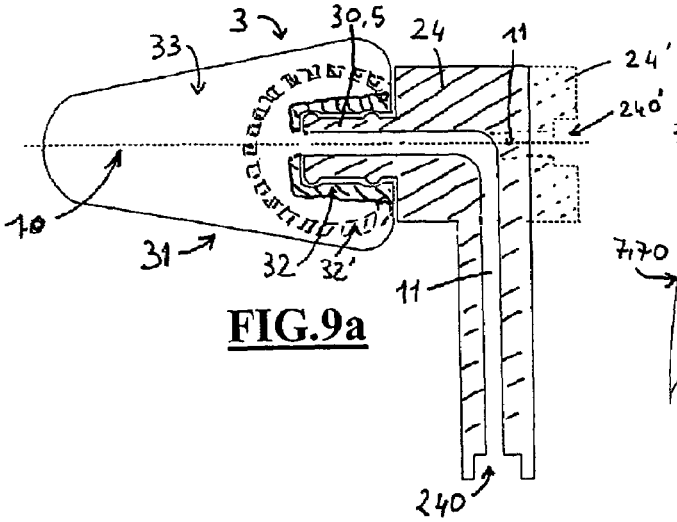
Figure 9C:
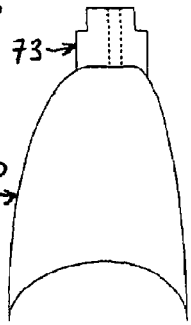
Figure 9D:
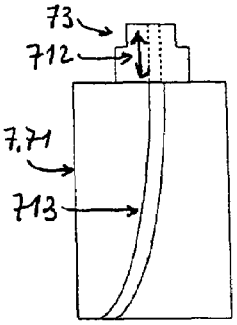

FIGS. 9*a* to 9*e* show a sectional view, in the plane of the rotation axis 10, of applicator-distributor embodiments 1' in which the said rotating element 31 is fixed to an end piece 24, 24', 24" on which the said fixed element 30 is fixed at one end and an assembly means 240, 240', 240" is supported on the other end with an output orifice, so as to cooperate with the different reservoirs 7 shown in FIGS. 9*c* and 9*d*.

Figure 9B:
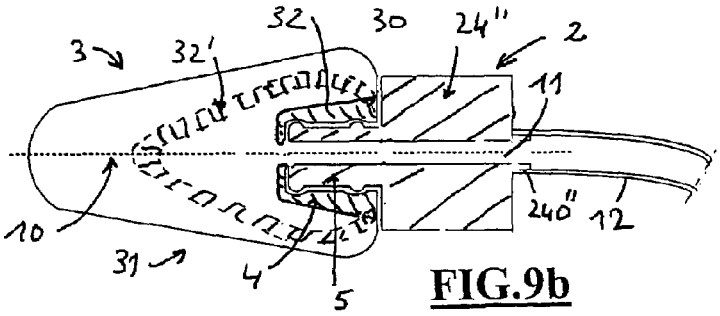
Figure 9E:
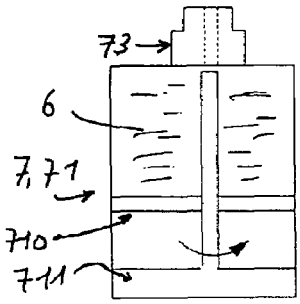
Figure 9F:
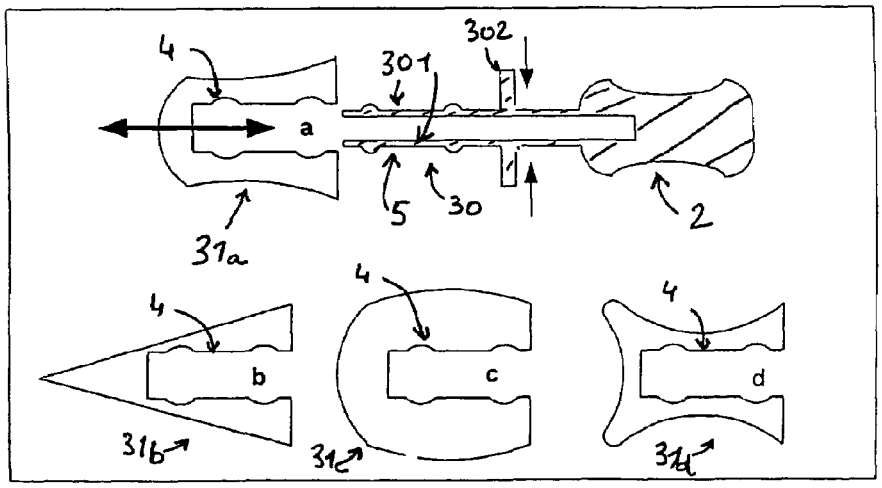

FIG. 9*f* illustrates an applicator embodiment 1 in which the said rotating element 31 is removable.

DETAILED DESCRIPTION OF THE INVENTION

Typically, and as shown in FIG. 7*b*, the said application means 3 comprising the said rotating element 31 may form a longitudinal element with a shape factor L/D>1, where L is the longest dimension or length of the said application means, dimension along the said rotation axis, and D is the largest diameter of the said rotating element. In general, L can typically vary from 5 mm to 30 mm.

According to a first embodiment of the invention, the said rotating element 31 may include the said hub 4, and the said fixed element 30 includes the said axle 5. This embodiment is shown in FIGS. 7*a* to 7*c*, 8*a*, 8*d*, 9*a*, 9*b* and 9*f*. This embodiment is also shown in FIGS. 3 and 4.

According to a first variant embodiment illustrated for example in FIG. 7*b*, the said axle 5 can cooperate with the said hub 4 through one end 40 of the said hub 4, in other words by a single side of the said rotating element 31, the said axle 5 extending over all or part of the length L of the said rotating element 31. In this case, a single male element cooperates with a single female element.

According to another variant embodiment shown in FIG. 8*a*, the said axle 5 may cooperate with the said hub 4 at the two axial ends 40, 40' of the said hub, the said axle 5 typically forming a pair of pins 5' facing each other, and the said hub possibly forming a pair of blind holes 4'. In this case, two male elements cooperate with two female elements.

According to a second embodiment of the invention, which is the reverse of the first, the said fixed element 30 may include the said hub 4 and the said rotating element 31 may include the said axle 5. This embodiment is shown in FIGS. 1*b*, 8*b* and 8*c*.

According to a first variant embodiment shown in FIG. 8*c*, the said hub 4 may cooperate with the said axle 5 through one end of the said axle 50. In this case, a single male element cooperates with a single female element.

According to a second variant embodiment shown in FIG. 8*b*, the said hub 4 may cooperate with the said axle 5 at the two ends of the said axle 50, 50', typically through a pair of blind holes 4' facing each other. In this case, two male elements cooperate with two female elements.

Regardless of the embodiments or variant manufacturing methods, the said rotating element 31 can cooperate with the said fixed element 30 typically by click fitting, the word "click fitting" covering any situation in which two distinct parts are assembled (reversibly or irreversibly) by applying a given tension, compression or spacing force on at least one of the parts to be assembled, the said force acting on the elasticity of the said parts.

Note that it is considered that the fixed element 30 and the rotating element 31 are click fitted in all cases shown in FIGS. 8*a* to 8*d*.

As shown in FIGS. 1*a*, 2*a*, 3, 8*a* to 8*d* and 9*a*, the said manual gripping means 2 may be positioned laterally with respect to the said rotation axis 10.

However, as shown in FIGS. 4, 7*a* to 7*c* and 9*b* or in FIG. 9*a* with the end piece 24' shown in dashed lines, the said manual gripping means 2 may typically be positioned in line with the axis of the said rotation axis 10.

In this case, as shown in FIG. 4, according to one of the applicator embodiments in FIG. 4, the said gripping means 2 may form the said fixed element 30 and may also form the said hub 4, the said rotating element 31 being fixed to a stick 34, one end of which forms the said axle 5 such that the "hub-axle" assembly is not in contact with the said product.

According to the invention, the said manual gripping means 2 may include means of cooperation with a receptacle forming a reservoir 7 for the said product 6, the said gripping means 2 typically forming a cap or a lid 8 for the said reservoir 7, so as to form an applicator-distributor 1'.

Examples of applicators-distributors 1' are given in FIGS. 1*a*, 1*b*, 3, 4, 7*c*, and FIGS. 9*a* to 9*e*.

According to one variant embodiment shown in FIGS. 3, 4 and 7*c*, the said manual gripping means 2 may form a reservoir 7 containing the said product 6, so as to form an applicator-distributor 1'.

Figure 1B:
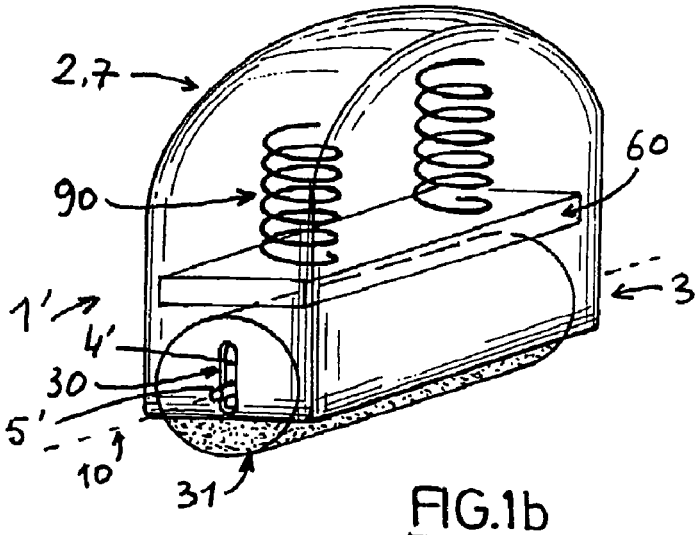

As shown in FIGS. 1*a* and 1*b*, when the said product 6 forms a solid block 60, the said manual gripping means 2 may include a means of transferring the said product, typically a spring 90, to apply the said block 60 in contact with the said rotating element 31.

As shown in FIGS. 3, 4 and 7*c*, and when the said product 6 is a fluid product 61, the said reservoir 7 may include a means of transferring the said product 6, 61 from the said reservoir 7 to the said rotating element 31, consisting of a duct 11 connecting the said reservoir 7 to the said rotating element 31.

The transfer means may include the use of a reservoir 7 with a flexible surface that can be compressed manually, the said reservoir 7 typically being a flexible ladle or a pack 70, such that gripping the said reservoir can apply a controlled pressure on the said reservoir 7 to induce a controlled flow of the said product to the said rotating element 31.

However, as shown in FIG. 9*a* associated with FIGS. 9*d* and 9*e*, the said reservoir 7 may form a rigid body 71, and in this case it is typically provided with a means of manual propulsion 710 of the said product. For example, this could be a pump 712 as shown diagrammatically in FIG. 9*d*, or an assembly comprising a piston 710 and a screw and knob assembly 711 as shown diagrammatically in FIG. 9.

However, it is possible that the said product can flow by gravity.

As illustrated particularly in FIG. 9*b*, the said manual gripping means 2 may be fixed to a reservoir 7 through a flexible or rigid reversible or irreversible connection means, typically consisting of a flexible tube 12 so as to form an applicator-distributor 1'.

In this case, the gripping means 2 and the reservoir 7 of the product 6 can be dissociated, so as to have a small and light-weight object in the user's hand, which can be advantageous for fine makeup.

Naturally, the applicator 1 according to the invention can also be associated with a reservoir 7 as shown in FIG. 7*a*.

According to the invention, the said rotating element 31 may comprise a rigid core 32 on the inside forming the said axle or the said hub, and a transfer or temporary retention material 33 of the said product 6 fixed to the said rigid core 32, typically so as to form a brush with bristles, or a foam-type cellular material, or a fibrous material such as felt or a woven or non-woven material, and/or an elastomer layer, on the outside.

The said rigid core 32 necessarily includes an orifice in the case of an applicator-distributor 1', so as to assure flow of the said product from the reservoir 7 as far as the material 33.

As shown in FIGS. 9*a* and 9*b*, the said rotating element 31 and/or the said rigid core 32 may comprise a part 32' provided with one or several orifices so as to provide uniform distribution or diffusion of the liquid product into the said rotating element or into the said transfer material 33.

As shown in FIGS. 1*a*, 1*b* and 2*a*, the said rotating element 31 may have a cylindrical shape so as to form a roller, the envelope of the said rotating element being a cylinder rotating about the said rotation axis 10.

Figure 2B:
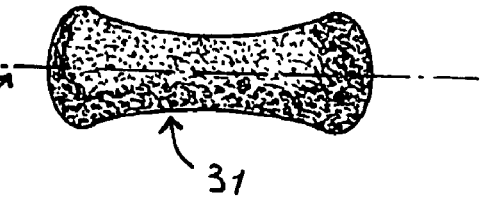

As shown in FIGS. 2*b*, 8*a* and 8*b*, the said cylinder may be curved, so as to have a concave curvature adapted to the said support.

As shown in FIGS. 8*c*, 8*d*, 9*a*, 9*b* and 9*f* (version b), the said rotating element 31 may have a conical or tapered shape, the envelope of the said rotating element 31 being a cone or a tapered cone rotating about the said rotation axis 10.

As shown in FIGS. 3, 4, 5*a* to 5*d*, 7*a* to 7*c*, the said tapered cone may be curved so as to have a curvature adapted to the said support.

Other forms are naturally possible according to the invention as shown in FIG. 9*f*, in particular so as to obtain curvatures adapted to the relief of the face and eyes.

As shown in FIGS. 5*a* to 5*d* and 6*a* to 6*e*, the said rotating element 31 may comprise at least one axial recess 311.

As shown in FIGS. 5*a* to 5*d* and 6*a* and 6*b*, the said rotating element 31 may comprise N axial recesses 311 distributed symmetrically about the said rotation axis, where N typically varies from 3 to 12.

These recesses may be filled with the product to be applied.

Furthermore, the said rotating element 31 may have a set of relief and recesses consisting of splines and ribs formed on the said application means itself, the said splines and ribs possibly being parallel, spiral, in diamond cut, in helix form, with a cylindrical, concave, convex or conical profile.

As shown in FIG. 8*b*, the said rotating element 31 may comprise two distinct application materials 33 and 33', with a junction typically perpendicular to the said rotation axis 10 at its middle, the said rotating element being typically convex, so that one or the other of the distinct materials 33 and 33' can be used.

As illustrated for example in FIG. 3, the said gripping means 2 can form a handle 20 typically with a narrowed part 21, so as to improve the ergonomics of the said manual gripping means 2.

Finally, as shown in FIG. 9*f*, the said fixed element 30 and the said rotating element 31 may be solidarised axially by reversible cooperation so as to form an assembly comprising firstly the said manual gripping means 2 fixed to the said fixed element 30, and secondly a series of rotating elements 31*a*, 31*b*, 31*c*, 31*d*.

EXAMPLE EMBODIMENTS

The figures form example embodiments of applicators 1 or applicator-distributors 1' according to the invention.

The applicator-distributor 1' is made according to FIGS. 1*a* and 1*b*.

In this applicator-distributor, the said product 6 is a compressed powder block 60, typically in an inverted cup, in which the said rotating element 31 is a cylindrical roller comprising two pins 5', one at each end of the cylindrical roller, each pin 5' cooperating with a longitudinal blind hole 4' on the inside face of the manual gripping means 2 forming the reservoir 7 for the said product 60. Springs 90 form a means of applying the said block in contact with the said roller, the said roller being capable of displacing elastically due to the longitudinal blind hole 4'.

In this applicator, the gripping means 2 is positioned laterally with respect to the rotation axis 10 of the rotating element 31.

This applicator is typically used for foundation makeup and for making up the cheeks.

Applicators 1 according to FIGS. 2*a* and 2*b* were also manufactured, with a straight or slightly concave "bobbin" shaped cylindrical roller.

This roller may have a splined or star type profile (cross-section perpendicular to the rotation axis).

A sponge was used as the transfer material 33 for the said rotating element 31.

This sponge can easily be separated from its support so that it can be cleaned, since the said rotating element is removable.

As shown in FIG. 2*a*, the gripping means 2 is slip resistant and comprises moulded grooves made of a supple material, and is curved at the centre so that the finger fits into it.

These applicators 1 are typically used for makeup of the cheeks and for foundation makeup.

An applicator 1, 1' was made as shown in FIG. 3. This applicator 1, 1' forms a handle 20 with a narrowed part 21 connected to the fixed element 30 that supports an axle 5 (not shown in the figure) to which the tapered rotating element 31 with a concave surface is fixed.

An applicator-distributor 1' was also made according to this FIG. 3, in which the said gripping means 2 also forms a reservoir 7 forming a flexible ladle capable of supplying the said rotating element 31 by applying a manual pressure on the said flexible pack, due to a duct connecting the said reservoir to the said fixed element 30.

This applicator 1, 1', considering the profile of the said rotating element 31 and the relative position of the said gripping means 2, is intended essentially for making up eyelids. However, it can also be used for making up lips and cheeks and for foundation makeup.

An applicator 1 was made as shown in FIG. 4 in which the said gripping means 2 is positioned in line with the rotation axis 10, the rotating element 31 forming a hub 4 cooperating with the fixed element 30—not shown on the figure—forming an axle 5 in line with the stick 22 fixed to the gripping means 2.

An applicator-distributor 1' was also made according to this FIG. 4, in which the said gripping means 2 forms a reservoir 7, the said stick forming a duct 11 connecting the reservoir 7 to the rotating element 31.

Two embodiments of this applicator were made, typically associated with a small flask containing the said product. In the first embodiment, the rotating element 31 is fixed to a stick 34, the lower end of which rotates in the gripping means 2 which then itself forms the said hub. In the second embodiment, the rotating element 31 turns on the fixed element 30 forming the extension of the stick 22, this rotating element forming the hub 4; the marks for this second embodiment are included between parentheses.

The advantage of the first embodiment is to prevent any risk of the "hub-axle" assembly becoming dirty or getting seized up by the said product, since this assembly is placed in the said gripping means and therefore does not come into contact with the said product.

Considering its profile, the applicator 1, 1' shown in FIG. 4 is typically intended for use on the lips. Its rotating element 31 forms a "mascara" type brush typically including a mix of cotton fibres to obtain a soft effect and avoid the prickly effect of normally used brushes, and synthetic fibres to make the assembly more rigid.

A rotating element 31 was also made according to FIGS. 5*a* to 5*d*, which is used particularly on the applicator in FIG. 4, with various rotating elements 31 according to FIGS. 6*a* to 6*e*.

An applicator 1 according to FIG. 7*a* was also made and a reservoir 7' with an upper end comprising a wiping ring 72 was associated with it. It should be noted that the rotating element 31 comprises several concave surfaces with different curvatures.

An applicator 1 according to FIG. 7*b* (partial view) was also made, the top part of the applicator being similar to the top part of the applicator 1 in FIG. 7*a*.

In this applicator 1, the said application means 3 is formed by cooperation of the fixed element 30 fixed to the gripping means 2 with the rotating element 31, typically by click fitting of ribs in relief 300 formed on the fixed element 30 forming an axle 5, into the recessed grooves 310 formed in the rotating element 31 forming a hub 4.

An applicator-distributor 1' as shown in FIG. 7*c* was also made comprising a flexible reservoir 7 that could be a flexible tube, the distributor being closed by a cap 8 shown in dashed lines.

Applicators according to FIGS. 8*a* and 8*b* were also made in which the said manual gripping means 2 comprises two side arms 23 oriented laterally with respect to the rotation axis 10 along the direction 13 of the said manual gripping means 2.

In FIG. 8*a*, the fixed element 30 is formed from two pins 5' forming the equivalent of the said axle 5, cooperating with two blind holes 4' in the rotating element 31 forming the equivalent of the said hub 4. On this figure, the rotating element 31 is shown as being formed of a typically rigid core 32 in which the said blind holes 4' are formed, and acting as a support for the transfer material 33.

In FIG. 8*b*, the fixed element 30 is formed from two blind holes 4' forming the equivalent of the said hub 4 cooperating with two pins 5' forming the equivalent of the said axle 5. On this figure, the rotating element 31 comprises two different transfer materials 33 and 33' side by side.

Applicators according to FIGS. 8*c* and 8*d* were made in which the said gripping means comprises a lateral arm 23 typically perpendicular to the rotation axis 10. In FIG. 8*c*, the rotating element 31 supports an axle 5 while the fixed element 30 forms the corresponding hub 4; FIG. 8*d* shows the reverse arrangement.

Applicators-distributors 1' according to FIGS. 9*a* to 9*e* were made in which the said rotating element 31 is fixed to an end piece 24, 24', 24" supporting the said fixed element 30 at one end and an assembly means 240, 240', 240" at the other end with an outlet orifice, so that it cooperates with different reservoirs 7.

In the applicator-distributor 1' in FIG. 9*a*, the end piece 24 forms an elbow at 90°, such that the associated reservoir 7 is typically arranged laterally with respect to the rotation axis 10.

On the other hand, a straight end piece 24' is shown in dashed lines on the same FIG. 9*a*, such that the associated reservoir 7 is typically arranged along the rotation axis 10.

In FIG. 9*b*, the end piece 24" is connected to a flexible tube 12 and itself forms the manual gripping means.

The rotating element 31 in FIGS. 9*a* and 9*b* comprises a rigid core formed from two click fitted parts 32 and 32', the part 32 forming the hub 4 cooperating with the fixed element 30 forming the axle 5, the part 32' forming a grill acting as a support for the said transfer material 33 so as to facilitate achieving a uniform distribution of the said product in the said transfer material 33.

The end pieces 24, 24' and 24" were coupled to different types of reservoirs according to FIGS. 9*c* to 9*d*, all these reservoirs 7 being provided with an assembly means 73, typically near their upper part, thus setting up communication between the reservoir and the duct 11 or tube 12.

Thus, the said reservoir 7 according to FIG. 9*c* is a ladle or a flexible pack 70 that can be manually compressed, so as to expel the said product.

Similarly, the said reservoir 7 according to FIG. 9*d* is a rigid body 71 provided with a pump 712.

Finally, the said reservoir 7 according to FIG. 9*e* is a rigid body 71 provided with a piston 710 moved by a screw and knob assembly 711.

An applicator 1 according to FIG. 9*f* was made in which the said fixed element 30 comprises two flexible tabs 301 forming the said axle 5, that can be compressed, for example using locking stops 302 so as to release the said rotating element 31, including four variants which are diagrammatically represented by the letters a to d. Thus, the said fixed element 30 and the said rotating element 31 are fixed by reversible cooperation.

Advantages of the Invention

The invention has many advantages.

The presence of a rotating element can firstly modify the aspect of the product applied compared with a traditional application, and secondly in many cases facilitate the said application.

Furthermore, the applicator 1, 1' according to the invention may be provided with curvatures adapted to the different parts of the face to be made up.

Thus for example, the applicator 1, 1' according to FIG. 4, will be an applicator adapted to the lips, since it can draw the outline of the lips and apply the product in a single pass, thus saving time, uniformity and regularity of the application no ("streaks").

The invention also includes a wide variety of embodiments or variant embodiments, such that it can be applied to all sorts of solid or fluid products, and to all sorts of usage conditions.

Finally, it can make a major contribution towards renewing the range of new products, both for applicators 1 alone or applicator-distributors 1', which is a great advantage in practice.

LIST OF MARKS

| | |
|---|---|
| Applicator | 1 |
| Applicator—distributor | 1' |
| Rotation axis | 10 |
| Duct between 7 and 31 | 11 |
| Flexible tube | 12 |
| Axis or direction of 2 | 13 |
| Manual gripping means | 2 |
| Handle | 20 |
| Narrowed part | 21 |
| Stick supporting 30 | 22 |
| Lateral arm | 23 |
| Lateral end piece | 24 |
| Assembly means to 73 | 240 |
| Axial end piece | 24' |
| Assembly means to 73 | 240' |
| Gripping means | 24" |
| Application means | 3 |
| Element fixed to 2 | 30 |
| Means of cooperation with 310 | 300 |
| Tab forming axle | 301 |
| Locking stop | 302 |
| Rotating element | 31 |
| Cooperation means with 300 | 310 |
| Axial recess | 311 |
| Axial tabs | 312 |
| Rigid core of 31 | 32 |
| Perforated rigid core fixed to 32 | 32' |
| Transfer material of 31 | 33, 33' |
| Support stick for 31 | 34 |
| Hub | 4 |
| Blind hole | 4' |
| End of 4 | 40, 40' |
| Axle | 5 |
| Pins | 5' |
| End of 5 | 50 |
| Product | 6 |
| Powder block | 60 |
| Fluid product | 61 |
| Reservoir 1' for 6 | 7 |
| Independent reservoir | 7' |
| Flexible pack, ladle | 70 |
| Rigid body | 71 |
| Propulsion means of 6 | 710 |
| Knurled knob for 710 | 711 |
| Pump | 712 |
| Plunger | 713 |
| Wiping ring | 72 |
| Assembly means to 240, 240' or 12 | 73 |
| Lid, cap | 8 |
| Means of transferring from 6 to 31 | 9 |
| Spring | 90 |

The invention claimed is:

1. An applicator (1, 1') for makeup intended to be deposited on a support such as a cheek, comprising:

a manual gripping means (2), including two side arms (23) at a first end and a joining portion at an opposite second end connecting the two side arms (23) to each other, the joining portion having a convex outermost surface portion facing opposite the first end; and an application means (3) for depositing the makeup to the support, comprising a fixed element (30) and a rotating element (31), the fixed element (30) fixed to the manual gripping means (2), and the fixed element (30) and the rotating element (31) cooperating in rotation to form a hub-axle assembly (4, 5) having a rotation axis (10) and first and second opposite end portions, wherein the fixed element (30) and the rotating element (31) are assembled together, wherein the manual gripping means (2) is positioned laterally with respect to the rotation axis (10) with the two side arms (23) each extending from a respective one of said first and second end portions of the hub-axle assembly (4, 5), wherein the rotating element (31) comprises i) a rigid core (32) forming one of the axle and the hub, and ii) a soft application material (33) fixed to and surrounding the rigid core (32) and configured to apply the makeup to the support, and wherein the rotating element (31) is configured to rotate upon i) the rotating element being brought into contact with the support and ii) a manual displacement of the gripping means (2) and application means (3) on the support, and thereby transfer the makeup from the rotating element to the support as a localized deposit of the makeup on the support.

2. The applicator according to claim 1, wherein the application means (3) forms a longitudinal element with a shape factor L/D>1, where L is a longest dimension of the application means along the rotation axis, and D is a largest diameter of the rotating element.

3. The applicator according to claim 2, wherein the rotating element (31) includes the hub (4), and the fixed element (30) includes the axle (5).

4. The applicator according to claim 3, wherein the axle (5) cooperates with the hub (4) at two opposite axial ends (40, 40') of the hub, the axle (5) forming a pair of pins (5') facing each other.

5. The applicator according to claim 4, wherein the rotating element (31) has a cylindrical shape forming a roller, an envelope of the rotating element being a cylinder configured to rotate about the rotation axis (10).

6. The applicator according to claim 1, wherein the rotating element (31) includes the hub (4), and the fixed element (30) includes the axle (5).

7. The applicator according to claim 6, wherein the axle (5) cooperates with the hub (4) at two opposite axial ends (40, 40') of the hub.

8. The applicator according to claim 7, wherein the axle (5) forms a pair of pins (5'), the pair of pins facing each other.

9. The applicator according to claim 1, wherein the fixed element (30) includes the hub (4) and the rotating element (31) includes the axle (5).

10. The applicator according to claim 9, wherein the hub (4) cooperates with the axle (5) at two opposite ends of the axle (50, 50').

11. The applicator according to claim 10, wherein the hub (4) cooperates with the axle (5) at the two opposite ends of the axle (50, 50') through a pair of blind holes (4'), the blind holes (4') facing each other.

12. The applicator according to claim 1, wherein the rotating element (31) cooperates with the fixed element (30) by click fitting.

13. The applicator according to claim 1, wherein the rotating element (31) has a cylindrical shape forming a roller, an envelope of the rotating element being a cylinder configured to rotate about the rotation axis (10).

14. The applicator according to claim 13, wherein the cylinder is curved to have a concave curvature adapted to the support.

15. The applicator according to claim 1, wherein the rotating element (31) comprises an axial recess (311).

16. The applicator according to claim 15, wherein the rotating element (31) comprises a plurality of axial recesses (311) distributed symmetrically about the rotation axis.

17. The applicator according to claim 16, wherein the axial recesses (311) number from 3 to 12.

18. The applicator according to claim 1, wherein the rotating element (31) has a set of reliefs and recesses consisting of splines and ribs formed on the application means.

19. The applicator according to claim 18, wherein the splines and ribs are one of parallel, spiral, diamond cut, and helical.

20. The applicator according to claim 18, wherein the splines and ribs have a profile that is one of cylindrical, concave, convex, and conical.

21. The applicator according to claim 1, wherein the soft application material comprises a first soft application material (33) and a second soft application material (33'), the first soft application material being different from the second soft application material.

22. The applicator according to claim 1, wherein the gripping means (2) forms a handle (20) with a narrowed part (21) configured to improve the ergonomics of the manual gripping means (2).

23. The applicator according to claim 1, wherein the soft application material forms brush bristles.

24. The applicator according to claim 1, wherein the soft application material is a foam-type cellular material.

25. The applicator according to claim 1, wherein the soft application material is a fibrous material.

26. The applicator according to claim 25, wherein the fibrous material is one of a felt, a woven material, and a nonwoven material.

27. The applicator according to claim 1, wherein the soft application material is an elastomer layer.

28. The applicator according to claim 1, wherein the fixed element (30) and the rotating element (31) have axial symmetry.

* * * * *

UNITED STATES PATENT AND TRADEMARK OFFICE

CERTIFICATE OF CORRECTION

PATENT NO. : 7,628,559 B2
APPLICATION NO. : 11/145066
DATED : December 8, 2009
INVENTOR(S) : Robert Petit It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 908 days.

Signed and Sealed this

Twenty-first Day of December, 2010

David J. Kappos

David J. Kappos
*Director of the United States Patent and Trademark Office*